US009366054B2

(12) United States Patent
Li

(10) Patent No.: US 9,366,054 B2
(45) Date of Patent: Jun. 14, 2016

(54) FOLDABLE TENT

(71) Applicant: Ki Ho Jin, Xiamen (CN)

(72) Inventor: Wen Xiang Li, Xiamen (CN)

( * ) Notice: Subject to any disclaimer, the term of this patent is extended or adjusted under 35 U.S.C. 154(b) by 0 days.

(21) Appl. No.: 14/511,247

(22) Filed: Oct. 10, 2014

(65) Prior Publication Data

US 2015/0167344 A1 Jun. 18, 2015

(30) Foreign Application Priority Data

Dec. 12, 2013 (CN) ..... 2013 2 0821242 U

(51) Int. Cl.
*E04H 15/48* (2006.01)
*E04H 15/58* (2006.01)
*E04H 15/42* (2006.01)

(52) U.S. Cl.
CPC ..... *E04H 15/48* (2013.01); *E04H 15/42* (2013.01); *E04H 15/58* (2013.01)

(58) Field of Classification Search
CPC ..... E04H 15/45; E04H 15/44; E04H 15/46; E04H 15/48; E04H 15/58
USPC ..... 135/117, 130, 135, 138, 139, 143, 147
See application file for complete search history.

(56) References Cited

U.S. PATENT DOCUMENTS 14,655 A 4/1856 Hartwell
58,283 A 9/1866 Palmer
379,274 A 3/1888 Hamilton
720,709 A * 2/1903 Lawrenz ..... E04H 15/003 135/117
2,113,118 A 4/1938 Pyatt
2,151,908 A * 3/1939 Gottlieb ..... E04B 1/3441 135/117
2,182,283 A * 12/1939 Curtis ..... E04H 15/48 135/117
2,306,706 A 12/1942 Lucas
2,448,895 A 9/1948 Lawrence
2,530,765 A 11/1950 Greenup
2,555,220 A 5/1951 Brown
2,725,887 A * 12/1955 Belfer ..... 135/147
2,731,972 A 1/1956 Braun
2,948,287 A 8/1960 Rupert
2,953,145 A 9/1960 Moss et al.
2,962,034 A 11/1960 Finlayson
2,984,249 A 5/1961 Sears, Jr. et al.
3,054,413 A 9/1962 Eshelman
3,221,756 A * 12/1965 Rupright ..... 135/98
3,333,373 A 8/1967 Taylor et al.
3,333,594 A * 8/1967 Moss ..... 135/88.14

(Continued)

FOREIGN PATENT DOCUMENTS

CA 2022369 A1 2/1991
CN 1030790 C 1/1996

(Continued)

*Primary Examiner* — Noah Chandler Hawk
(74) *Attorney, Agent, or Firm* — John H. Choi

(57) ABSTRACT

A foldable tent includes a frame coupled to a canopy such that the frame and canopy are collectively collapsible from an open configuration to a folded configuration. The frame includes a plurality of spaced apart hubs positioned at an upper portion of the frame, at least one upper roof pole pivotally coupled with two adjacent hubs, a plurality of lower roof poles pivotally coupled to a corresponding hub and extending radially outward from each respective hub and away from the upper roof pole, and a plurality of collapsible side poles coupled to a corresponding lower roof pole. An eave pole pivotally coupled to a hub extends the canopy to form an eave or an extended roof.

9 Claims, 9 Drawing Sheets

(56) References Cited

U.S. PATENT DOCUMENTS

| | | | | | |
|---|---|---|---|---|---|
| 3,621,857 | A | * | 11/1971 | May et al. | 135/94 |
| 3,738,378 | A | | 6/1973 | Williams | |
| 3,810,482 | A | | 5/1974 | Beavers | |
| 3,834,410 | A | * | 9/1974 | Leibel | E04H 15/425 135/123 |
| 3,838,703 | A | | 10/1974 | Zeigler | |
| 3,929,146 | A | | 12/1975 | Maiken | |
| 4,077,417 | A | | 3/1978 | Beavers | |
| 4,078,572 | A | | 3/1978 | Moss | |
| 4,148,332 | A | | 4/1979 | Huddle | |
| 4,201,237 | A | | 5/1980 | Watts et al. | |
| 4,280,521 | A | | 7/1981 | Zeigler | |
| 4,285,354 | A | | 8/1981 | Beavers | |
| 4,285,355 | A | * | 8/1981 | Lundblade | 135/147 |
| 4,506,688 | A | * | 3/1985 | Bethoon et al. | 135/140 |
| 4,627,210 | A | | 12/1986 | Beaulieu | |
| 4,637,748 | A | | 1/1987 | Beavers | |
| 4,750,509 | A | | 6/1988 | Kim | |
| 4,787,182 | A | | 11/1988 | Serge | |
| 4,819,680 | A | | 4/1989 | Beavers | |
| 4,838,003 | A | | 6/1989 | Zeigler | |
| 4,941,499 | A | | 7/1990 | Pelsue et al. | |
| 4,971,090 | A | | 11/1990 | Uhl | |
| 4,998,552 | A | | 3/1991 | Niksic et al. | |
| 5,195,551 | A | | 3/1993 | Ju | |
| 5,293,890 | A | | 3/1994 | Park et al. | |
| 5,299,590 | A | * | 4/1994 | Deibert et al. | 135/125 |
| 5,328,286 | A | | 7/1994 | Lee | |
| 5,333,634 | A | | 8/1994 | Taylor | |
| 5,361,794 | A | | 11/1994 | Brady | |
| 5,423,341 | A | | 6/1995 | Brady | |
| 5,573,028 | A | | 11/1996 | van der Stigohel | |
| 5,617,681 | A | | 4/1997 | Lyons | |
| 5,628,338 | A | | 5/1997 | Stumbo | |
| 5,634,483 | A | | 6/1997 | Gwin | |
| 5,666,986 | A | | 9/1997 | Fox | |
| 5,732,726 | A | | 3/1998 | Lee | |
| 5,797,695 | A | | 8/1998 | Prusmack | |
| 5,871,026 | A | * | 2/1999 | Lin | 135/98 |
| 5,884,646 | A | | 3/1999 | Ju | |
| 5,943,837 | A | | 8/1999 | Esser et al. | |
| 6,021,795 | A | | 2/2000 | Long et al. | |
| 6,021,796 | A | | 2/2000 | Vavra | |
| 6,032,430 | A | | 3/2000 | Soukup | |
| 6,167,898 | B1 | | 1/2001 | Larga et al. | |
| 6,286,530 | B1 | | 9/2001 | Hussey | |
| 6,296,415 | B1 | | 10/2001 | Johnson et al. | |
| 6,463,948 | B2 | * | 10/2002 | Lee | 135/156 |
| D470,907 | S | | 2/2003 | Ju | |
| 6,516,823 | B1 | | 2/2003 | Glover et al. | |
| 6,591,571 | B2 | | 7/2003 | Fritsche et al. | |
| 6,604,844 | B2 | | 8/2003 | Hussey | |
| 6,666,223 | B2 | | 12/2003 | Price et al. | |
| 6,718,995 | B2 | * | 4/2004 | Dotterweich | E04H 15/50 135/117 |
| 6,772,780 | B2 | | 8/2004 | Price | |
| 6,776,179 | B1 | | 8/2004 | Chen | |
| 6,854,476 | B1 | | 2/2005 | Chai | |
| 6,868,858 | B2 | | 3/2005 | Suh | |
| 6,874,519 | B2 | | 4/2005 | Chiang | |
| 6,892,744 | B2 | | 5/2005 | Feldpausch et al. | |
| 7,025,075 | B2 | | 4/2006 | Suh | |
| 7,040,585 | B2 | | 5/2006 | Cheng et al. | |
| 7,059,094 | B2 | | 6/2006 | Yamawaki | |
| D535,350 | S | | 1/2007 | Ju | |
| D544,941 | S | | 6/2007 | Rogers | |
| 7,311,113 | B2 | | 12/2007 | Suh | |
| 7,401,618 | B2 | | 7/2008 | Caldwell | |
| RE40,544 | E | | 10/2008 | Suh | |
| 7,481,235 | B2 | | 1/2009 | Prusmack | |
| 7,546,845 | B2 | | 6/2009 | Prusmack | |
| 7,766,023 | B2 | | 8/2010 | Scherer | |
| 8,448,656 | B2 | | 5/2013 | Choi | |
| 8,590,554 | B2 | | 11/2013 | Choi et al. | |
| 2003/0005953 | A1 | | 1/2003 | Erbetta et al. | |
| 2004/0050413 | A1 | * | 3/2004 | Cooper | 135/143 |
| 2007/0051399 | A1 | | 3/2007 | Jung | |
| 2007/0215192 | A1 | | 9/2007 | Hoffman | |
| 2007/0240747 | A1 | * | 10/2007 | Scherer | 135/131 |
| 2009/0308419 | A1 | * | 12/2009 | You | 135/20.1 |
| 2012/0125389 | A1 | | 5/2012 | Vaughn et al. | |
| 2013/0068269 | A1 | * | 3/2013 | Gao | 135/145 |
| 2014/0076372 | A1 | | 3/2014 | Jin | |

FOREIGN PATENT DOCUMENTS

| | | | | | |
|---|---|---|---|---|---|
| CN | 2506736 | Y | | 8/2002 | |
| CN | 2635827 | Y | | 8/2004 | |
| CN | 201129060 | Y | | 10/2008 | |
| CN | 202706658 | U | | 1/2013 | |
| CN | 202767622 | U | | 3/2013 | |
| EP | 1310616 | A2 | | 5/2003 | |
| GB | 2259927 | A | | 3/1993 | |
| GB | 2300011 | A | | 10/1996 | |
| GB | 2321656 | A | | 8/1998 | |
| GB | 2201703 | A | | 9/1998 | |
| GB | 2382358 | A | * | 5/2003 | E04H 15/28 |
| GB | 2482745 | A | | 2/2012 | |
| KR | 20060117478 | A | * | 11/2006 | |

* cited by examiner

FOLDABLE TENT

CROSS REFERENCES TO RELATED APPLICATIONS

This application claims priority to China App. No. 201320821242.8 (filed Dec. 12, 2013), which is incorporated by reference in its entirety.

BACKGROUND OF THE INVENTION

The present invention relates to a tent and more particularly to a foldable or collapsible tent.

For novice campers and camping families, among others, foldable tents are a popular alternative to conventional assemble-to-use tents. These tents are commonly referred to as "instant tents," "one-touch tents" or "pop-up tents." Foldable tents are typically sold with a frame assembly and tent fabric permanently attached to each other, i.e., preassembled. Erecting and collapsing the tent is easy and less time consuming than conventional assemble-to-use tents because the frame assembly and tent fabric are collectively opened and folded. The frame assembly usually includes a single central hub and a plurality of poles pivotally attached to the hub to provide a stable tent structure. These types of instant tents are particularly advantageous because a minimal number of poles, typically four, are required and thus erecting and collapsing the instant tent is quite simple. Although convenient for the user, there are several disadvantages for instant tents in the prior art.

For example, a large amount of stress is exerted on the frame assembly due to the tension from the tent fabric. These stresses are often transferred to and concentrated on the single central hub where the poles are interconnected, especially when a wind force is exerted on the tent. Thus, there is risk of damage or even failure of the central hub.

Also, the size of instant tents in the prior art today are limited because stability of the structure is compromised with longer poles required for larger instant tents. Therefore, even though there is great interest for bigger tents (often including separate rooms), this cannot be achieved with an instant tent today. Instead, larger tents that could accommodate many people are of the conventional type which requires the user to separately assemble the poles and then attach the poles to the tent fabric for set up, and detach the poles from tent fabric and disassemble the poles to store and transport.

Another disadvantage of instant tents of the prior art is that head room is limited. The central portion of the instant tent where the central hub is located serves as the apex of the tent. Even though cabin instant tents attempt to solve this problem, the poles are positioned downwardly and the ceiling height decreases from the central portion of the tent. Thus, head room is still limited at radially outer portions of the tent.

As another example, instant tents in the prior art are limited in shape. They are either dome shape or a single rectangular cabin. The use of a single central hub also limits the overall configuration of the instant tent because the overall length of the tent is restricted by the length of the poles which can securely extend from the central hub. Therefore, a tent with a more elongated configuration or other configurations cannot be achieved.

Instant tents today also pose problems with folding the tent into a relatively short and compact state. The folded length of the tent as well as the volume of the tent is dictated by the sections of the poles which are connected to the central hub and because those pole sections are usually elongated to increase the overall volume of the tent in the open configuration, the instant tent is relatively long when folded.

Another problem with instant tents today is the lack of an integral rain fly that provides sufficient head room for the user.

OBJECTS AND SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention is intended to overcome at least the above-described disadvantages. The objects and advantages of the present invention, more specifically, are to provide: an instant tent where the stresses exerted on the frame are more evenly distributed so that the risk of damage or failure to the frame assembly is reduced; a safe instant tent with larger volume so that more people could be accommodated; an instant tent with increased head room throughout the tent; an instant tent having configurations other than dome or traditional cabin configurations; an instant tent capable of folding into a more compact state; and an instant tent with eave structures for providing integral rain flies with sufficient head room.

For achieving the above-mentioned objects, the present invention provides a foldable tent convertible between an open configuration and a folded configuration, said tent comprising: a plurality of central hubs spaced apart from each other; a plurality of roof poles coupled to a respective central hub; a plurality of leg poles corresponding to the number of roof poles, wherein the plurality of roof poles and leg poles support a tent fabric; and at least one eave pole, wherein each eave pole supports an eave section of the tent fabric.

The at least one eave pole can be pivotally coupled to a respective one of the central hubs. Also, the at least one eave pole can be coupled to an upper portion of the eave section. The tent fabric can comprise a plurality of adjoining canopy walls and a floor coupled together at seams to form an enclosure; and wherein the eave section forms an eave of the enclosure. In addition, the at least one leg pole can be a flexible pole. In one embodiment, each flexible pole includes fiberglass. In another embodiment, each flexible pole includes fiberglass reinforced plastic. In a further embodiment, the at least one leg pole includes a pair of flexible poles which supports a front section of the tent fabric, wherein the front section includes a front opening.

The pair of flexible fiberglass poles can support the eave section in conjunction with the respective eave pole. In another embodiment, the at least one flexible pole shapes the tent fabric to form a dome shape. In a further embodiment, the plurality of central hubs includes a pair of outer central hubs and an intermediate central hub between the outer central hubs. The at least one eave pole can extend from the intermediate central hub. In addition, the at least one eave pole can extend from at least one of the outer central hubs.

The present invention also provides a foldable tent convertible between an open configuration and a folded configuration, said tent comprising: a plurality of central hubs spaced apart from each other; a plurality of roof poles coupled to a respective central hub; a plurality of leg poles corresponding to the number of roof poles, wherein the plurality of roof poles and leg poles support a tent fabric; and at least one eave pole extending from at least one of the central hubs, wherein each eave pole supports an eave section of the tent fabric. The plurality of central hubs can include at least two outer central hubs, and an intermediate central hub between the outer central hubs. The at least one eave pole can extend from the intermediate central hub. Alternatively, the at least one eave pole can extend from one of the outer central hubs.

The present invention further provides a foldable tent convertible between an open configuration and a folded configuration, said tent comprising: a plurality of central hubs spaced apart from each other; a plurality of roof poles coupled to a respective central hub; a plurality of leg poles corresponding to the number of roof poles, wherein the plurality of roof poles and leg poles support a tent fabric; and at least one eave pole extending from at least one of a central hub, a roof pole, and a leg pole, wherein each eave pole supports an eave section of the tent fabric. The at least one eave pole can be pivotally coupled to the at least one of the central hub, the roof pole, and the leg pole. The plurality of central hubs can include at least two outer central hubs, and an intermediate central hub between the outer central hubs.

BRIEF DESCRIPTION OF THE DRAWINGS

To better understand the present invention, a more particular description of the invention will be rendered by reference to the appended drawings.

Figure 1:
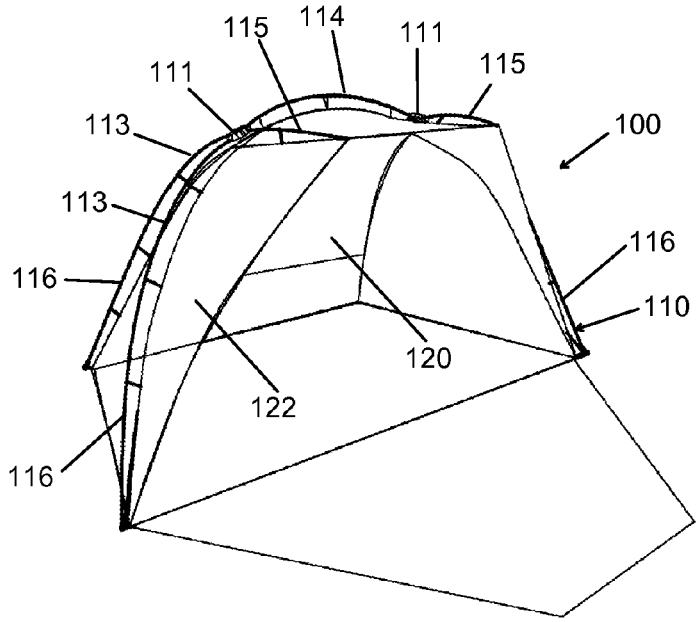
FIG. 1 is a top side perspective view of an embodiment of a foldable tent of the present invention in an open configuration having two hubs and holding a tent fabric.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Certain terminology is used in the following description for convenience only and is not limiting. The article "a" is intended to include one or more items. Where only one item is intended, the term "one" or similar language is used. Additionally, to assist in the description of the present invention, words such as top, bottom, front, rear, right and left are used to describe the accompanying figures. The terminology includes the words above specifically mentioned, derivatives thereof, and words of similar import.

Figure 6:
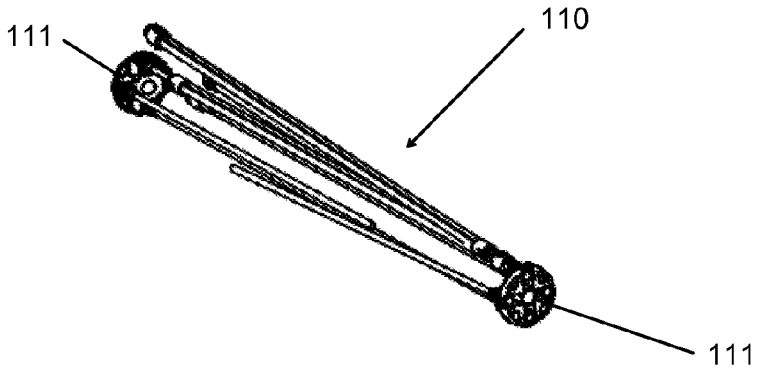
FIG. 6 is a top perspective view of the frame assembly of FIG. 5 in a completely folded configuration.
Figure 7:
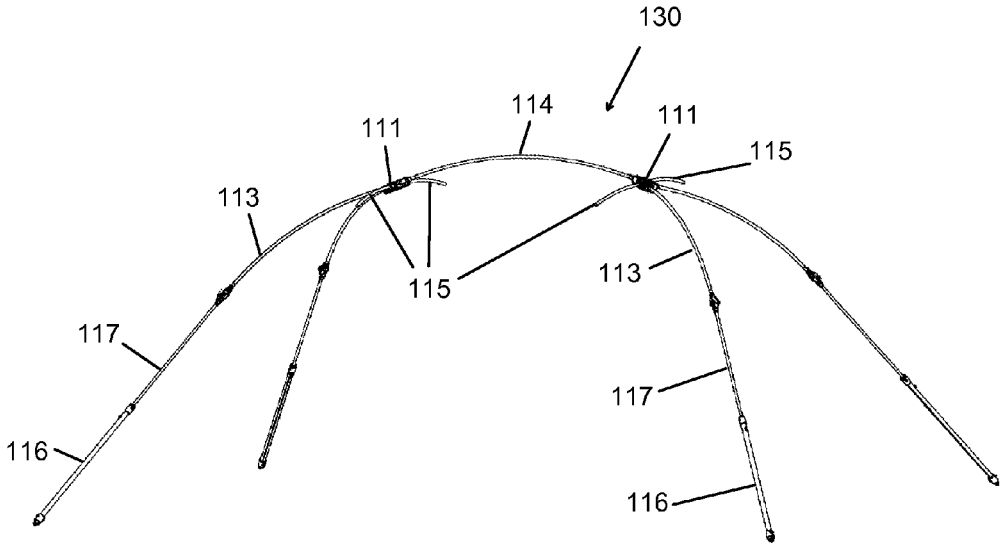
FIG. 7 is a top perspective view of an embodiment of a frame assembly of the tent shown in FIG. 7A in an open configuration and without a tent fabric.
Figure 8:
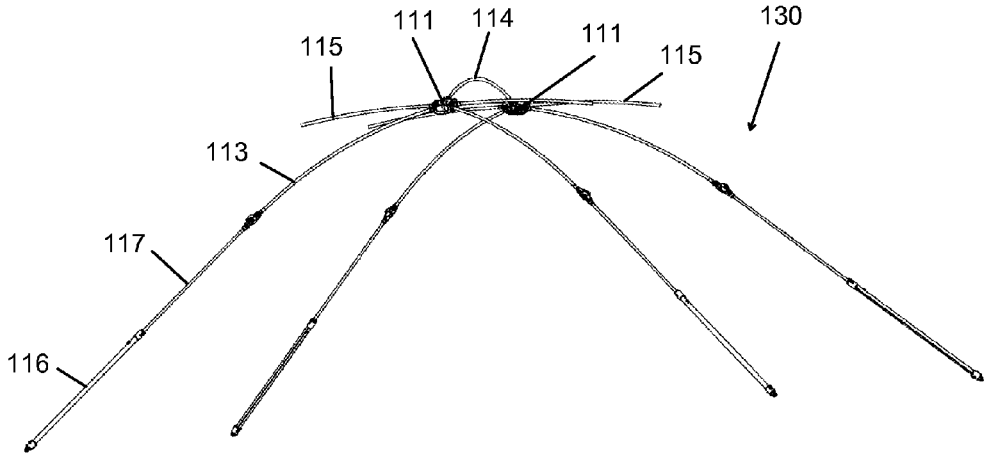
FIG. 8 is a side perspective view of the frame assembly of FIG. 7.
Figure 7A:
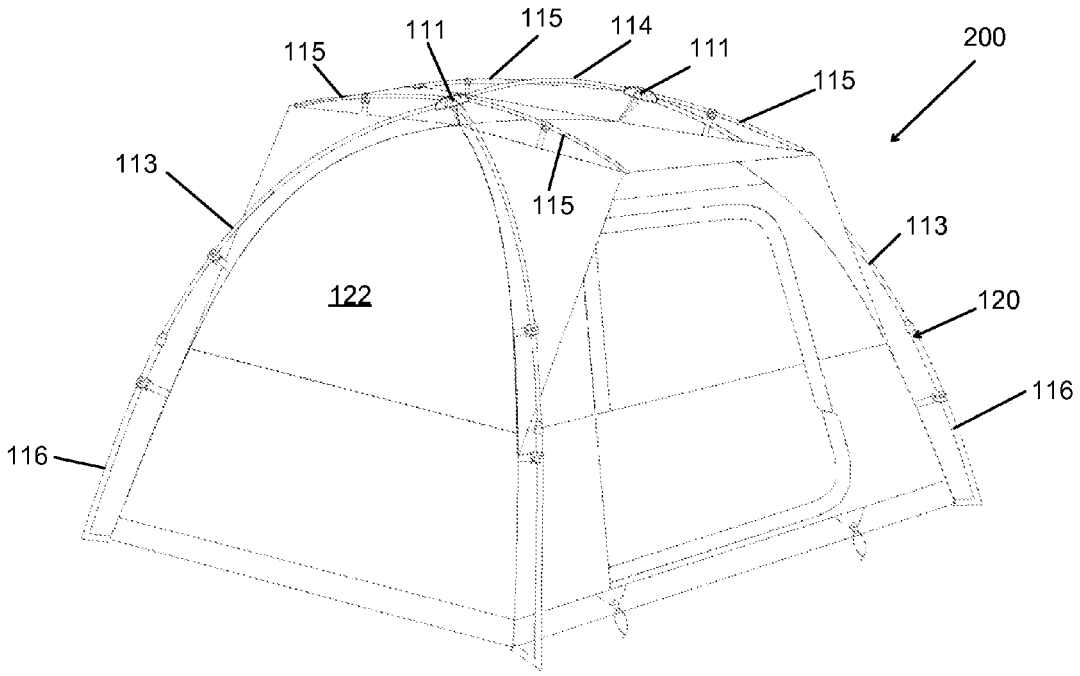
FIG. 7A is a perspective view of another embodiment of a foldable tent of the present invention having two hubs in an open configuration.
Figure 9:
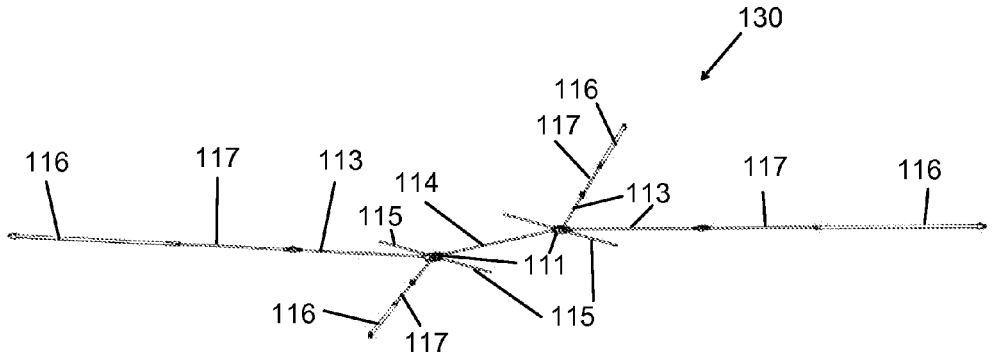
FIG. 9 is a top perspective view the frame assembly of FIG. 8 in an open and flat configuration.
Figure 10:
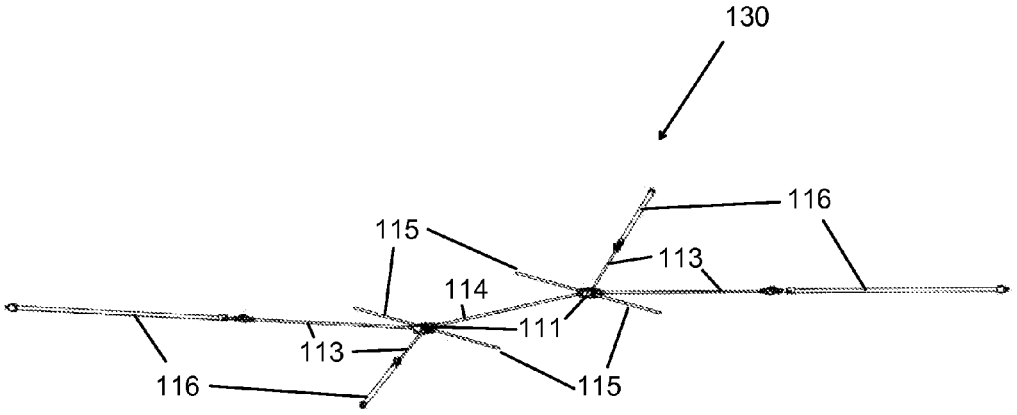
FIG. 10 is a top perspective view of the frame assembly of FIG. 9 in a partially folded configuration.
Figure 11:
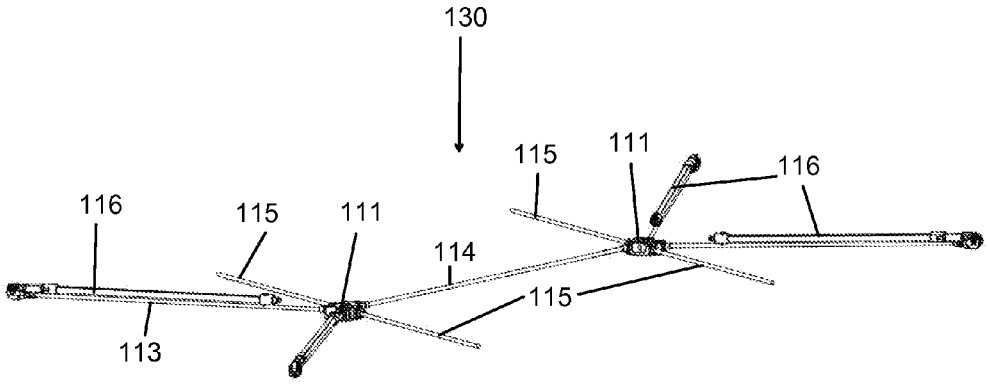
FIG. 11 is a top perspective view of the frame assembly of FIG. 10 in a further partially folded configuration.
Figure 12:
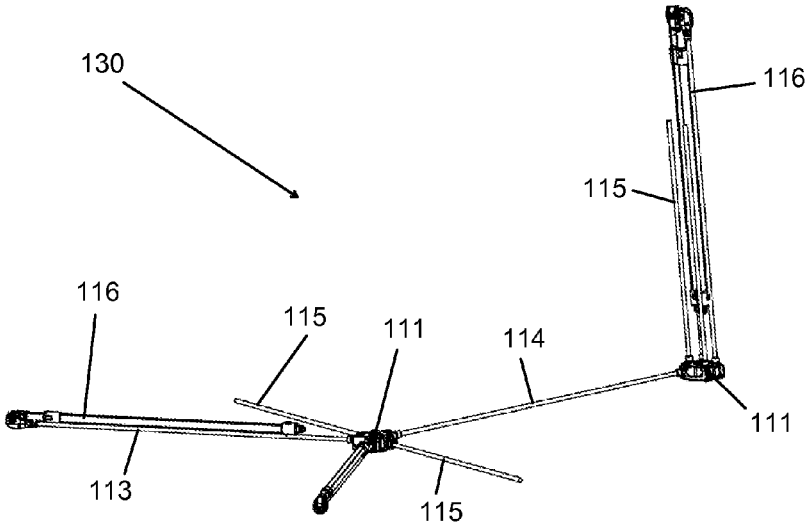
FIG. 12 is a top perspective view of the frame assembly of FIG. 11 in a further partially folded configuration.
Figure 15:
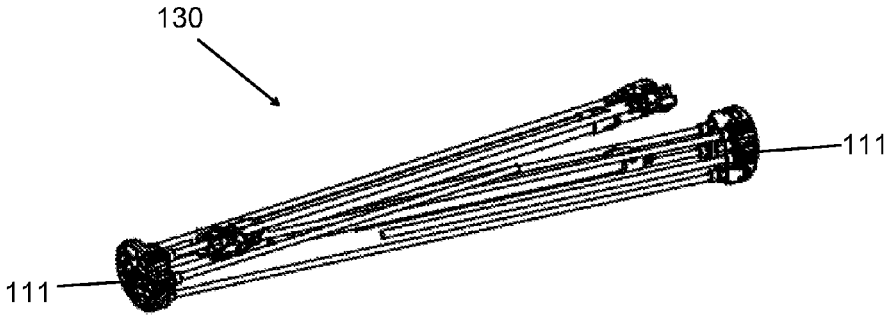
FIG. 15 is a top perspective view of the frame assembly of FIG. 14 in a completely folded configuration.

Referring to FIGS. 1 and 7A, various embodiments of a foldable tent of the present invention are shown. Each of these embodiments include a frame assembly as illustratively shown in FIGS. 2-6 and 7-15, respectively, under which tent fabric is held and shaped to form portions of the tent, such as roof sections, side sections, sections with openings and/or windows, and eave sections, as shown in FIGS. 1 and 7A. Each of the frame assemblies in FIGS. 2-6 and 7-15, is foldable from an open configuration as shown in FIGS. 2 and 7, respectively, to respective completely folded configurations such as shown in FIGS. 6 and 15.

Referring to FIGS. 2-6 and 7-15, the frame assemblies generally include a plurality of spaced apart hubs which are configured to receive poles, such as roof poles, leg poles, and eave poles. Such roof poles, leg poles, and eave poles can be in pivotal engagement with one or more of the hubs and other roof, leg and eave poles.

In a first embodiment of a tent 100, as shown in FIGS. 1-6, the tent frame assembly 110 has a pair of hubs 111, and each hub 111 includes four slots 112 for pivotally attaching poles 113, 114, 115 but additional slots or fewer slots could be included depending on the desired overall configuration of the tent 100. The poles 113, 114 are roof poles to which leg poles 116 are further attached, while the poles 115 are eave poles which form an eave of the tent 100. Each pole 113, 114, 115 is attached to a corresponding slot in a respective hub 111 by a fastener such as a screw or pin which extends through opposing apertures (or partial apertures) of each slot. In the closed configuration each pole is pivotable upwardly to a position substantially perpendicular to a top surface of the hub 111 as illustrated in the drawings of the folded configuration of the frame assemblies, and in the open configuration each pole 113, 114, 115 is pivotable downwardly to a position where the poles 113, 114, 115 extend radially outwardly from the hub 111 as illustrated in the drawings of the open configuration of the frame assemblies. The angle at which each pole 113, 114, 115 extends in the open configuration depends on the configuration of a top surface of each slot in the hub 111 and the position of the apertures. Thus, the positions of the top surface and apertures could be adjusted to form a desired extending angle for each pole. Other instant tent hubs capable of having poles pivotable upward to the folded configuration, such as those described in U.S. Pat. Nos. 8,448,656 and 8,590,554, as well as U.S. Patent Pub. No. 20120318316, which are incorporated by reference their entireties, could be used herein without departing from the spirit and scope of the present invention.

Figure 2:
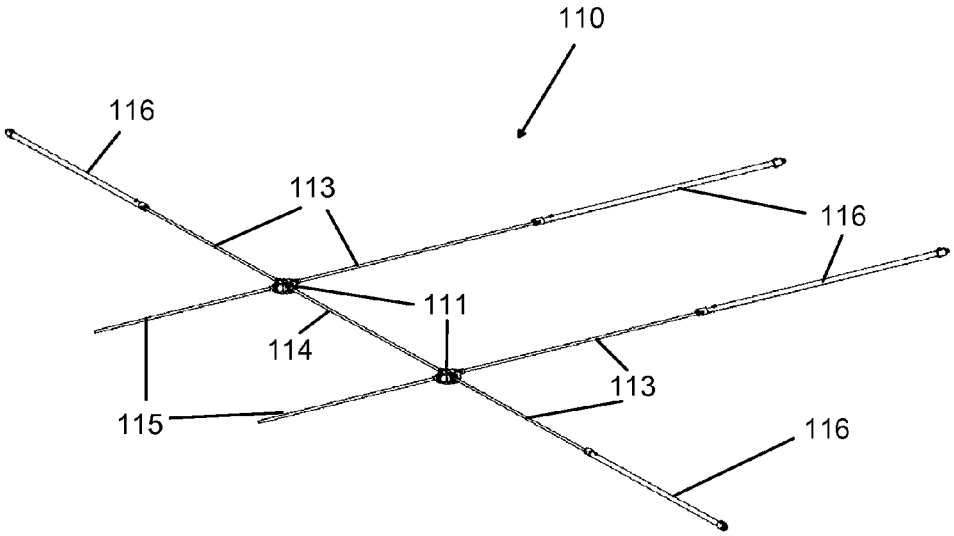
FIG. 2 is a top perspective view of a frame assembly of the foldable tent of FIG. 1 in an open and flat configuration.

As shown in FIG. 2, one of the slots of each hub 111 faces the other such that a central roof pole 114 is pivotally attached to the opposing hubs 111. When in the open configuration, the central roof pole 114 provides more head room compared with conventional single hub foldable tents. In this embodiment, the central roof pole 114 is one continuous piece but it could also be constructed of multiple sections coupled together telescopically or pivotally if a more elongated tent configuration is desired.

Referring to FIG. 2, each roof pole 113 has an inner end and an outer end, with the inner ends pivotally connected to each hub 111, and the outer ends pivotally connected to a respective leg pole 116. Each eave pole 115 has an inner end and an outer end, with the inner end pivotally connected to a respective hub 111, and an outer end terminating, for example, with a plug or a hook to which a portion of the tent fabric is secured to extend and form an eave section. For example, two eave poles 115 as shown in FIG. 2 may form a pair which holds the eave fabric over an open section of the tent fabric, as shown in FIG. 1.

Still referring to FIG. 2, the frame assembly 110 also includes a plurality of leg poles 116. Each leg pole 116 includes an inner end and an outer end. In this embodiment, two leg poles 116 support each side of the frame assembly 110. The inner ends are pivotally connected to each hub 111 as described above and the leg poles 116 are extended radially outward and away from the central roof pole 114. As mentioned above, additional leg poles 116 could be attached to each hub 111 depending on the desired configuration of the tent. Alternatively, the combination of a roof pole 113 and a leg pole 116 can form a leg assembly, with the roof pole 114 being an upper section of the leg assembly, and the leg pole being a lower section of the leg assembly. In this embodiment, the diametrical dimensions of the poles 113, 116 are such that the poles 113, 116 are telescopically coupled together and lockable in an extended position by conventional means, for example, with a locking mechanism having a spring biased pin extending through aligned apertures of each pole 113, 116. However, one of ordinary skill in the art will recognize that other methods and means could be used to couple and lock the poles 113, 116 including but not limited to a lockable pole joint such that the poles 113, 116 are lockably extended, and unlocked and pivotably folded toward each other.

In one embodiment, each of the poles 113-116 is constructed of a rigid tubular steel having a diameter between 14.5 mm and 16 mm. However, in another embodiment, as shown in FIGS. 2-6, the poles 113-115 are constructed of a flexible material, for example, flexible fiberglass reinforced plastic (FRP), and the leg poles 116 are constructed of tubular steel such that each roof pole 113 is telescopically retractable within a corresponding lower pole 116. One of ordinary skill in the art will recognize that other materials such as other metals (e.g., aluminum), metal alloys, other polymers, composite materials or any combination thereof could be used, and different sizes of poles could be used depending on desired strength without departing from the spirit and scope of the invention.

Referring to FIG. 1, the tent 100 includes a tent fabric or canopy 122 which is disposed within the radially inner space 120 formed by the frame assembly 110 with the eave poles 115 forming an eave or roof of the tent fabric 122. In the embodiment shown in FIG. 1, the tent fabric 122 has a roof or eave, side walls and a floor stitched together to form a partial enclosure typically used as a shelter or beach tent. However, the tent 100 could be constructed with more or less features than shown. In addition, portions of the tent fabric 122 could be constructed with mesh or other air permeable materials to provide additional ventilation. Also, each of the hubs 111 could be covered with a fabric casing to protect the tent fabric 122 from damage when the tent 100 is folded. The tent fabric 122 is attached by slidable hooks at various locations to the frame assembly 110. The hooks could also be replaced by other conventional attachment means such as hook-and-loop, hook-and-eye or the like. In the alternative, the tent fabric 122 could be attached to the frame assembly 110 by fabric sleeves integral to and extending from the tent fabric 122. In the open configuration as shown in FIG. 1, the tent fabric 122 is substantially taut and forms a substantially flat surfaces on the roof, eave, side walls and floor. The frame assembly 110 is further stabilized by the tension created by the tent fabric 122. A curvature is formed on the roof pole 113 as well as the leg poles 116 due to the utilization of flexible FRP and a dome style tent is provided.

Figure 3:
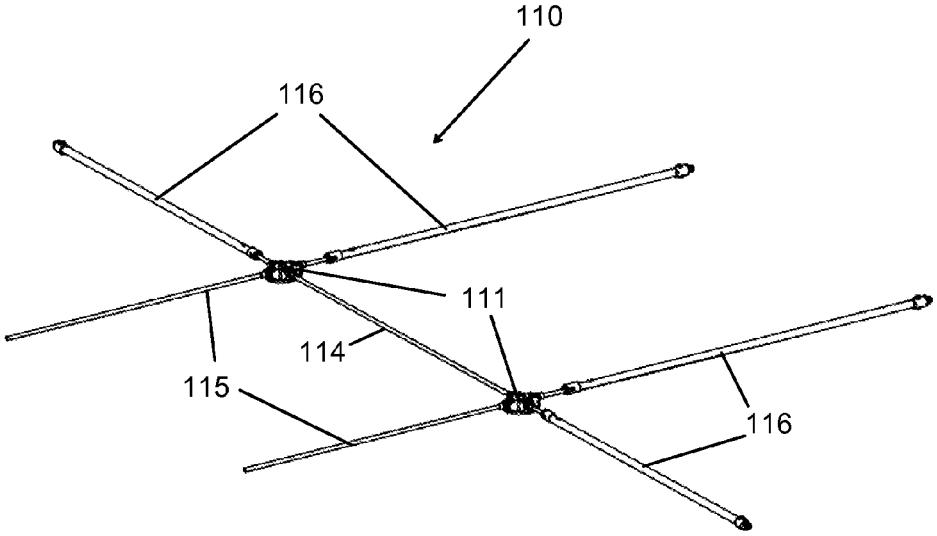
FIG. 3 is a top perspective view of the frame assembly of FIG. 2 in a partially folded configuration.
Figure 4:
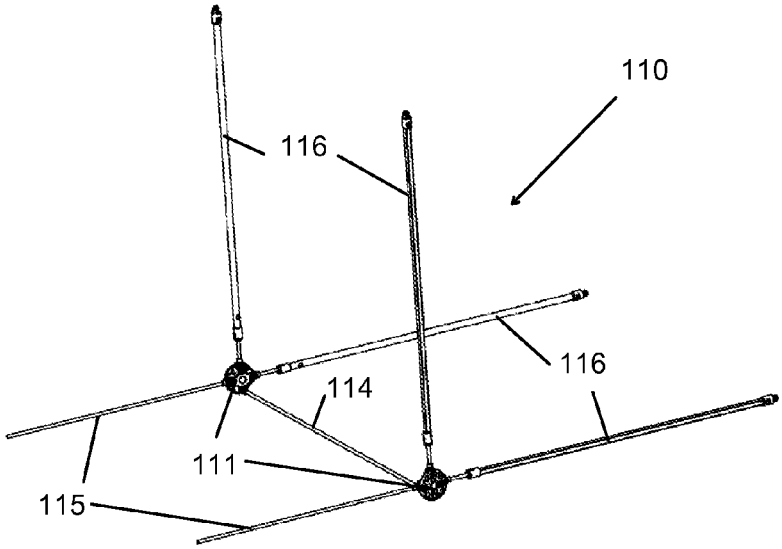
FIG. 4 is a top perspective view of the frame assembly of FIG. 3 in a further partially folded configuration.
Figure 5:
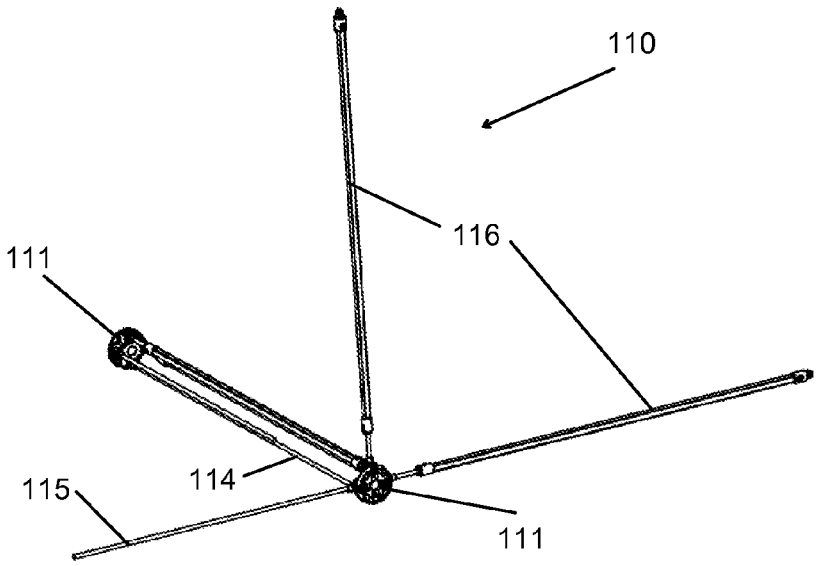
FIG. 5 is a top perspective view of the frame assembly of FIG. 4 in a further partially folded configuration.

Referring to FIGS. 2-6, even though the tent fabric 122 is attached to the frame assembly 110 at all times, the operation of the embodiments of the foldable tent 100 is shown without the tent fabric 122 and the frame assembly 110 is shown in a flag configuration for purposes of clarity. From the open configuration (FIG. 2), the roof poles 113 are retracted into the leg poles 116 (FIG. 3). Each hub 111 is pivoted toward each other (FIG. 4) and each of the poles 115, 116 are then pivoted toward and adjacent to the central roof pole 114 (FIGS. 5-6). In the fully folded configuration, the remaining extended eave pole 115 and retracted leg poles 116 are pivoted, and top portions of each hub 111 face each other and the poles 113, 115, 116 are in substantial parallel relationship (FIG. 6). The tent 100 having the frame assembly 110 is unfolded to the open configuration in reverse order of the steps described above and shown in FIGS. 2-6.

Referring to FIG. 7A, another embodiment of a tent 200 of the present invention is shown. The tent 200 includes another embodiment of a frame assembly 120 which includes the components of the frame assembly 110 described above, the description of which is incorporated by reference. The tent 200, however, is different from the first tent 100 in that the position of the roof and leg poles 113, 116 are shifted to the sides of the tent 200 rather than the side and rear of the tent 100 so that a more rectangular tent is formed. The frame assembly 120 also includes eave poles 115 which extend to the rear of the tent 200. Also, the tent fabric 122 of the tent 200 includes a front wall to form an enclosure. Here, the roof or eave extends over the front and rear to provide additional protection from rain and/or sunlight while also providing sufficient head room for the user.

Referring to FIGS. 7-15, another embodiment of a frame assembly 130 is shown. In this embodiment, at least one intermediate pole 117 having an inner end and an outer end is provided, with the inner end of each intermediate pole 117 pivotally connected to an outer end of a roof pole 113, and the outer end of each intermediate pole 117 telescopically connected to an inner end of a leg pole 116. However, the connections between each pole section could vary.

Figure 13:
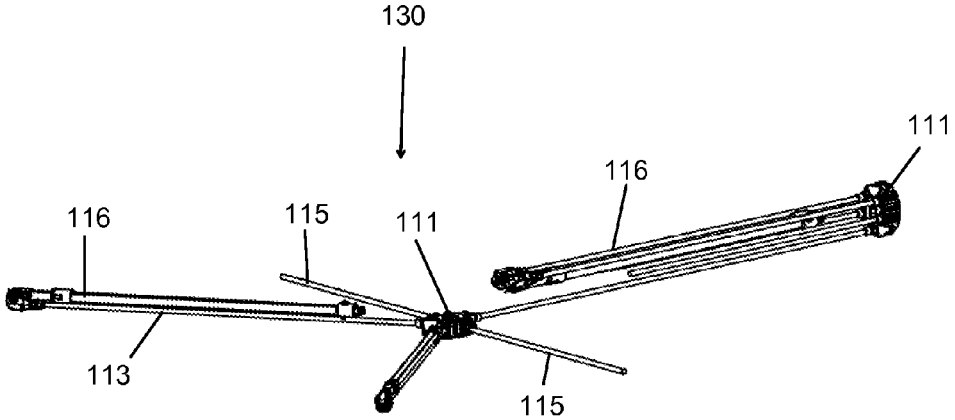
FIG. 13 is a top perspective view of the frame assembly of FIG. 12 in a further partially folded configuration.
Figure 14:
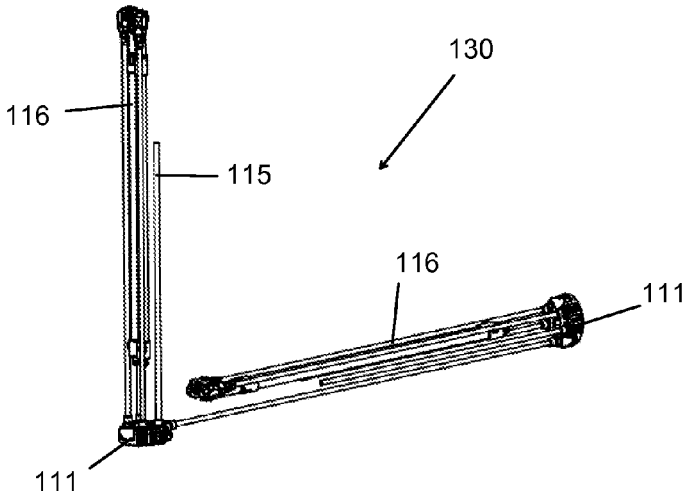
FIG. 14 is a top perspective view of the frame assembly of FIG. 13 in a further partially folded configuration.

Referring to FIGS. 7-15, the operation of the embodiment of the foldable tent 200 is shown without the tent fabric 122 and the frame assembly 130 is shown in a flag configuration (FIGS. 9-15) for purposes of clarity. In a manner similar to the folding of the frame assembly 110 in FIGS. 2-6, the frame assembly 130 is folded from the open configuration (FIG. 7-9) to a partially folded configuration (FIG. 10) in which each intermediate pole 117 is retracted into its respective leg pole 116. The retracted leg poles 116 are then pivoted towards their respective roof poles 113 (FIG. 11), and a pair of the retracted leg poles 116 and a pair of eave poles 115 are pivoted about their respective hub 111 (FIG. 12), and further pivoted toward the central roof pole 114 (FIG. 13). The remaining pair of retracted leg poles 116 and pair of eave poles 115 are pivoted about their respective hub 111 (FIG. 14), and further pivoted toward the central roof pole 114 to be in the folded configuration (FIG. 15). A tent having the frame assembly

130 is unfolded to the open configuration in reverse order of the steps described above and shown in FIGS. 7-15. The use of the frame assembly 130 is particularly useful for larger tents.

The structure of these embodiments of instant tents 100, 200 of the present invention provides stability and could be constructed as an instant tent or shelter of all sizes.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A foldable tent convertible between an open configuration and a folded configuration, said tent comprising:

a pair of central hubs spaced apart from each other;

a central roof pole having opposing ends, each opposing end pivotally coupled to a respective central hub, the central roof pole extending laterally across the tent;

a plurality of roof poles, each roof pole pivotally coupled to a respective central hub;

a plurality of leg poles corresponding to the number of roof poles, each leg pole pivotally coupled to a respective roof pole, wherein the central roof pole, plurality of roof poles and leg poles support a tent fabric; and a plurality of eave poles, each eave pole pivotally coupled to a respective central hub, wherein each eave pole supports an eave section of the tent fabric.

2. The foldable tent of claim 1, wherein each eave pole is coupled to an upper portion of the eave section.

3. The foldable tent of claim 1, wherein the tent fabric comprises a plurality of adjoining canopy walls and a floor coupled together at seams to form an enclosure; and wherein the eave section forms an eave of the enclosure.

4. The foldable tent of claim 1, wherein at least one leg pole is a flexible pole.

5. The foldable tent of claim 4, wherein each flexible pole includes fiberglass.

6. The foldable tent of claim 4, wherein the at least one leg pole includes a pair of flexible poles which supports a front section of the tent fabric, wherein the front section includes a front opening.

7. The foldable tent of claim 6, wherein the pair of flexible poles supports the eave section in conjunction with the respective eave pole.

8. The foldable tent of claim 4, wherein the at least one flexible pole shapes the tent fabric to form a dome shape.

9. The foldable tent of claim 1, wherein in the folded configuration the roof poles and eave poles are pivoted upward with respect to each central hub.

* * * * *